US008662822B2

(12) United States Patent
Dittmar et al.

(10) Patent No.: US 8,662,822 B2
(45) Date of Patent: Mar. 4, 2014

(54) SIDE CHANNEL COMPRESSOR

(75) Inventors: Rudi Dittmar, Schmalkalden (DE); Mario Kempf, Bad Neustadt (DE); Thomas Grohmann, Meiningen (DE)

(73) Assignee: Gardner Denver Deutschland GmbH, Bad Neustadt (DE)

( * ) Notice: Subject to any disclaimer, the term of this patent is extended or adjusted under 35 U.S.C. 154(b) by 695 days.

(21) Appl. No.: 12/680,216

(22) PCT Filed: Oct. 29, 2008

(86) PCT No.: PCT/EP2008/009131

§ 371 (c)(1),
(2), (4) Date: Oct. 25, 2010

(87) PCT Pub. No.: WO2009/059719

PCT Pub. Date: May 14, 2009

(65) Prior Publication Data

US 2011/0052378 A1 Mar. 3, 2011

(30) Foreign Application Priority Data

Nov. 5, 2007 (DE) ..... 10 2007 053 016

(51) Int. Cl.
*F04D 29/42* (2006.01)

(52) U.S. Cl.
USPC ..... 415/55.2

(58) Field of Classification Search
USPC ..... 415/53.1, 53.2, 54.1, 55.1, 55.2, 55.3, 415/55.4
See application file for complete search history.

(56) References Cited

U.S. PATENT DOCUMENTS 5,281,083 A * 1/1994 Ito et al. ..... 415/55.1
6,779,968 B1 8/2004 Rietschle et al.

FOREIGN PATENT DOCUMENTS

| | | | | |
|---|---|---|---|---|
| DE | 876 285 | | 7/1949 | |
| DE | 42 20 153 | A1 | 12/1992 | |
| DE | 0863314 | A1 * | 3/1998 | ..... F04D 23/00 |
| DE | 197 08 952 | A1 | 9/1998 | |
| DE | 199 13 950 | A1 | 9/2000 | |
| EP | 0863314 | A1 * | 3/1998 | ..... F04D 23/00 |
| EP | 0 863 314 | A1 | 9/1998 | |
| GB | 1 237 363 | | 6/1971 | |

OTHER PUBLICATIONS

EP0863314A1_Description_MachineTranslation.*
EP0863314A1_DerwentSummary.*

(Continued)

*Primary Examiner* — Edward Look
*Assistant Examiner* — Juan G Flores
(74) *Attorney, Agent, or Firm* — James B. Conte; Husch Blackwell LLP

(57) ABSTRACT

A side channel compressor for compressing a gas comprises a housing (3), a side channel (30), located in the housing (3) and having a cross-sectional area (A), for compressing a gas, a gas inlet opening (31) formed in the housing (3), the gas inlet opening (31) being in flow connection with the side channel (30) for introducing a gas, a gas outlet opening (32) formed in the housing (3) for discharging the gas to be compressed from the side channel (30), wherein the gas outlet opening (32) is in flow connection with the gas inlet opening (31) via the side channel (30), and an impeller (2) which is mounted for rotation in the housing (3) and comprises impeller blades (1) disposed in the side channel (30), wherein the cross-sectional area (A) of the side channel (30) decreases non-monotonically from the gas inlet opening (31) towards the gas outlet opening (32).

13 Claims, 4 Drawing Sheets

(56) References Cited

OTHER PUBLICATIONS

Preliminary Report on patentability with Annexes based on International Application No. PCT/EP2008/009131 (12 pages).
Reply to Written Opinion of the International Searching Authority for PCT/EP2008/009131 (12 pages).
Search Report for PCT/EP2008/009131.
Partial Machine Translation of DE 976 285.
Written Opinion of International Searching Authority for PCT/EP2008/009131.
English translation of abstract of DE19708952 (A1).
English translation of abstract of DE19913950 (A1); DE19913950 (A1) was previously disclosed as US 6,779,968.
DE translation for DE 876 285, previously erroneously disclosed as translation for DE 976 285.

* cited by examiner

A
1
S
B
E
3
T
2
14
13
41
31
5
9
4
35
32
H
10

SIDE CHANNEL COMPRESSOR

BACKGROUND OF THE INVENTION

1. Field of the Invention

The invention concerns a side channel compressor for compressing a gas. The invention therefore concerns a work machine for compressing gases, such as air or technical gases.

2. Background Art

The operation of the side channel compressor results in a broadband sound spectrum. In conventional side channel compressors, tonal sound components occur at certain frequencies of the side channel compressor which are extremely annoying if they differ from the broadband sound spectrum by more than 7 dB.

SUMMARY OF THE INVENTION

It is the object of the invention to provide a side channel compressor which ensures a particularly silent operation.

This object is achieved by a side channel compressor for compressing a gas, the side channel compressor comprising a housing; a side channel for compressing a gas, the side channel being located in the housing and having a cross-sectional area; a gas inlet opening formed in the housing, the gas inlet opening being in flow connection with the side channel for introducing a gas; a gas outlet opening formed in the housing for discharging the gas to be compressed from the side channel, with the gas outlet opening being in flow connection with the gas inlet opening via the side channel; and an impeller which is mounted for rotation in the housing and comprises impeller blades disposed in the side channel; wherein the cross-sectional area of the side channel decreases from the gas inlet opening towards the gas outlet opening.

The essence of the invention is that the cross-sectional area of the side channel tapers between the gas inlet opening and the gas outlet opening, with the result that detachments at the edges and at the back of the impeller blades are minimized such that the turbulence intensity in the side channel is reduced considerably. This ensures a particularly silent operation.

When seen from the gas inlet opening towards the gas outlet opening, the side channel advantageously tapers irregularly; a continuous, in particular linear, decrease in cross-sectional area is not desirable. Said decrease may be strictly monotonic or non-monotonic. In contrast to a monotonic decrease, a non-monotonic decrease is characterized in that the cross-sectional area of the side channel may increase in some regions or may even remain constant. Likewise, the cross-sectional area may also comprise regions that taper more quickly as well as regions that taper less quickly. When the decrease is strictly monotonic, the cross-sectional area does not increase at all but tapers to various degrees. This means that there may be regions that taper more quickly as well as regions that taper less quickly. This prevents formation of regular harmonic flow structures and ultimately reduces tonal sound components even further. The gas in the side channel is therefore in particular subject to an irregular change of velocity, in other words the velocity of the delivered gas is bound to increase and decrease again. This applies not only to the absolute velocity of the gas in the side channel but also to the relative velocity between the gas in the side channel and an impeller blade transporting the gas.

The following is a detailed description of several embodiments of the invention, taken in conjunction with the enclosed drawings.

DESCRIPTION OF THE PREFERRED EMBODIMENTS

Figure 1:
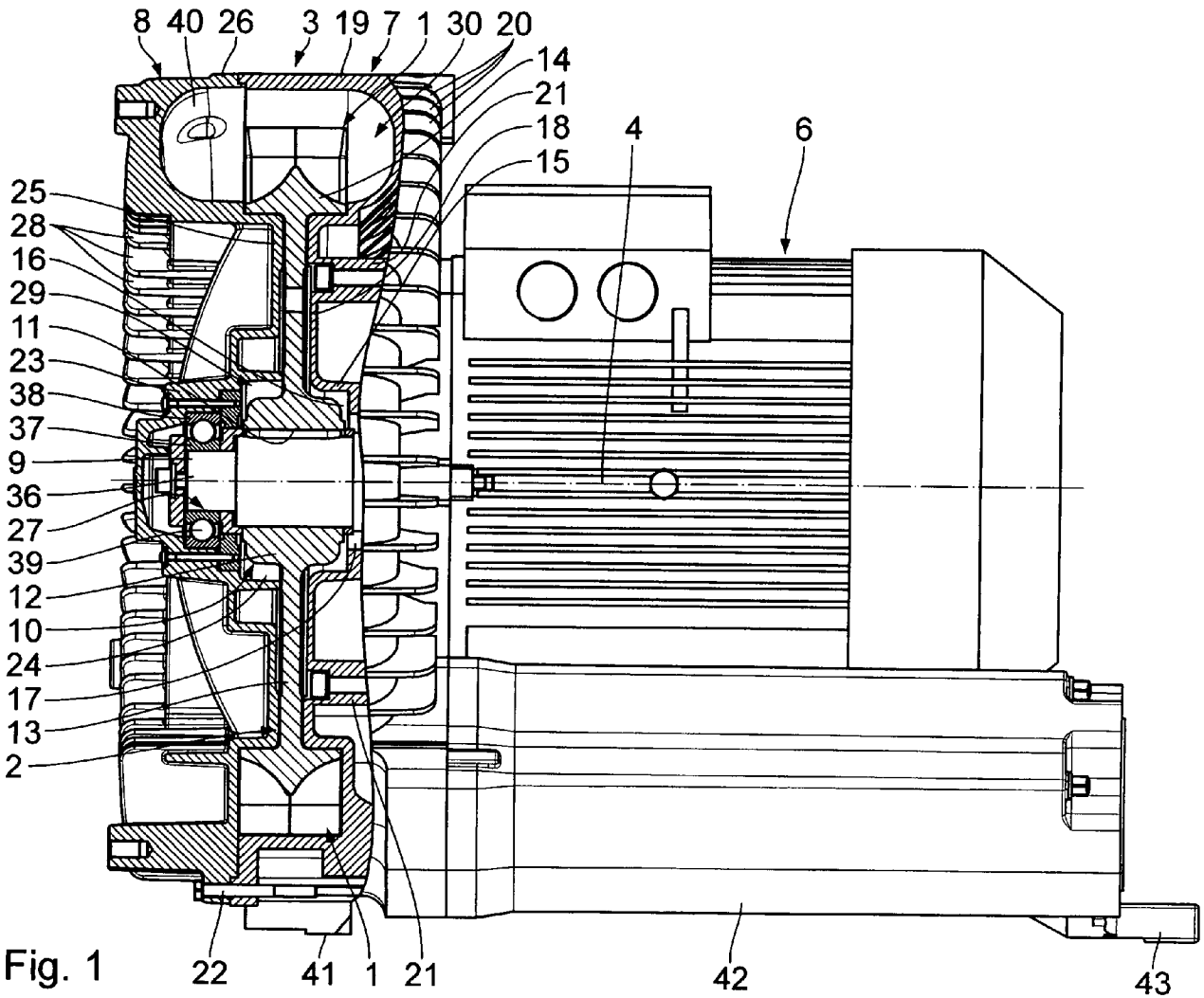
FIG. 1 shows a side view of an inventive side channel compressor and a drive that is flange-mounted to the side channel compressor, the Figure showing a partial longitudinal sectional view of the side channel compressor.
Figure 2:
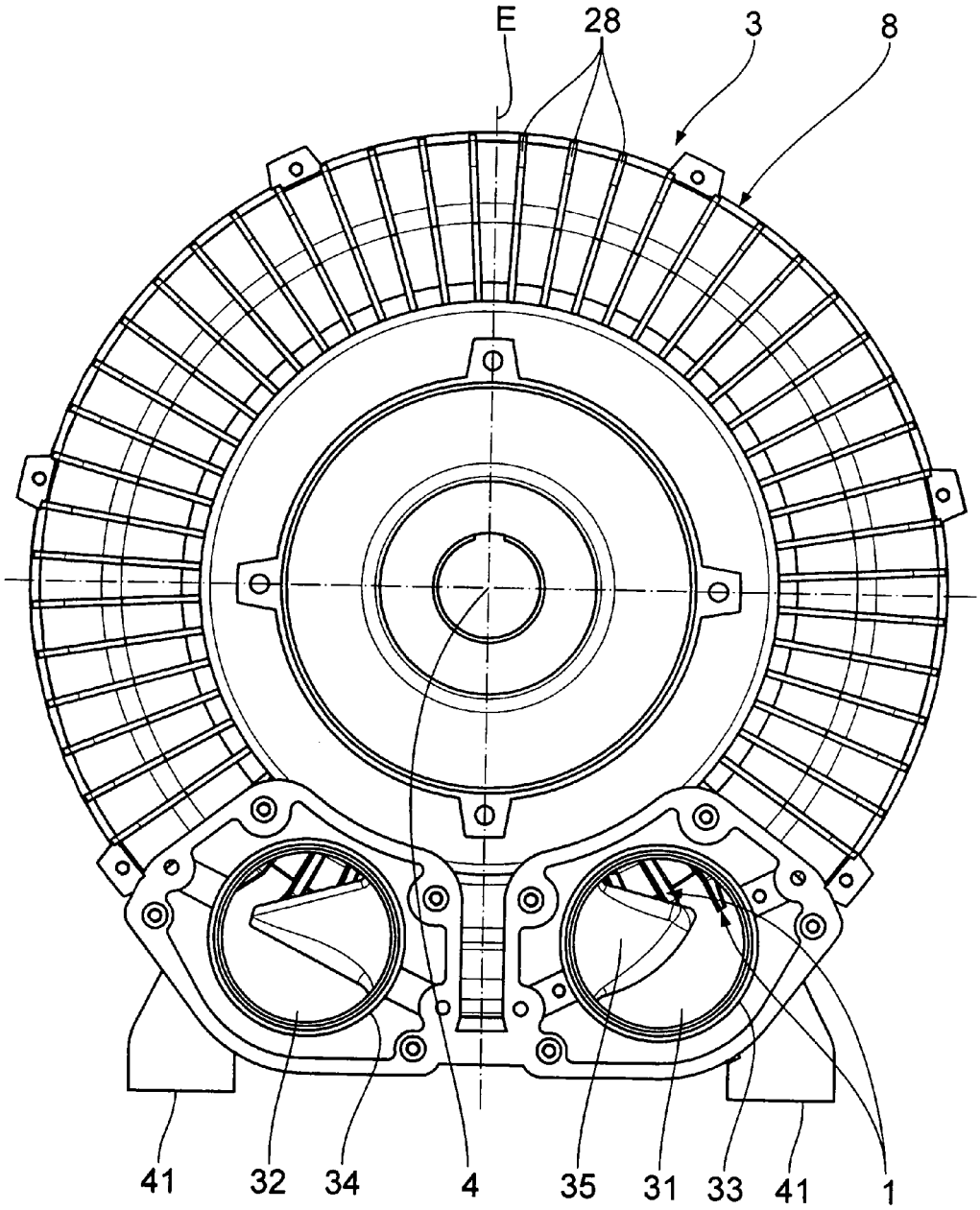
FIG. 2 shows a front elevation view of the side channel compressor shown in FIG. 1.
Figures 3, 4, 5, 6, 7, 8, 9, 10:
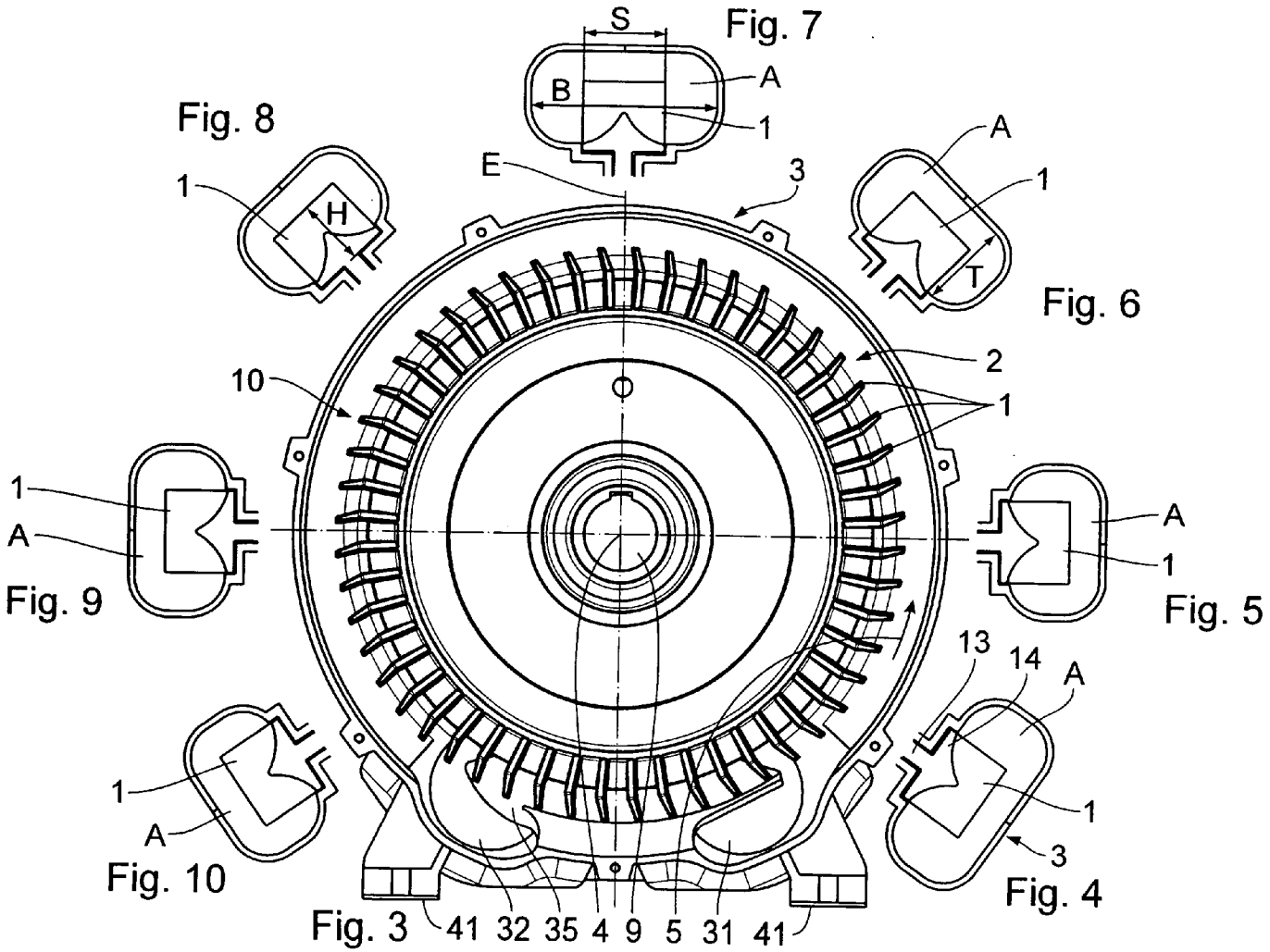
FIG. 3 shows a front elevation view of the side channel compressor shown in FIG. 2 with its housing cover detached.
FIG. 4-10 in each case show a cross-sectional view of the side channel, seen at various angular positions of the side channel compressor shown in FIG. 1.

A side channel compressor shown in FIGS. 1 to 3 for compressing a gas comprises an impeller 2 which is equipped with impeller blades 1 and mounted for rotation about a horizontal central longitudinal axis 4 in a housing 3. A conventional drive 6 is used for rotary drive of the impeller 2 in the direction of the arrow 5. The gas is thus transported through the housing in the direction of the arrow 5 as well.

The housing 3 comprises a housing body 7 and a detachable housing cover 8 that are joined together according to FIGS. 1 and 2 so as to enclose the impeller 2 comprising the impeller blades 1, the impeller 2 being disposed for rotary drive on a drive shaft 9 for co-rotation therewith.

The impeller 2 is shaped like a disk. The impeller 2 comprises an inner impeller hub 10 with a central circular hub bore 11. The impeller hub 10 is formed by an inner hub foot 12 which radially outwardly delimits the hub bore 11, and by a radial circular hub washer 13 neighboring said hub foot 12. The impeller 2 further comprises a radial outer carrier ring 14 which adjoins the outside of the hub washer 13 and overlaps with both sides thereof in the direction of the central longitudinal axis 4. The carrier ring 14 carries a multitude of radially projecting impeller blades 1 that are distributed along the circumferential direction. The present embodiment is provided with a total of 52 separate and identical impeller blades 1 that are disposed equidistantly, which means they are spaced from each other by an angular distance of approximately 7° relative to the central longitudinal axis. Thus, 6 to 7 impeller blades 1 are disposed at every 45°. The impeller blades 1 in each case have a radially outer portion that is inclined forwardly in the direction of the arrow 5. The hub foot 12, the hub washer 13 and the carrier ring 14 form an integral cast part.

The terms "axial" and "radial" used in this disclosure are relative to the central longitudinal axis 4.

The central hub bore 11 serves to receive the drive shaft 9. A conventional parallel-key connection is provided between the drive shaft 9 and the hub foot 12 for transmitting the torque generated by the drive shaft 9 to the impeller hub 10 for rotating the impeller.

The housing body 7 comprises a central hub portion 15 which radially and axially delimits a partial hub receiving space 16. Through the hub portion 15 passes a central shaft bore 17 that opens into the partial hub receiving space 16. An radially outwardly extending annular side wall 18 adjoins the hub portion 15. A circumferential channel portion 19 adjoins the outside of the side wall 18. The hub portion 15, the side wall 18 and the channel portion 19 form an integral cast part which forms the housing body 7. Rib webs 20 extending in a spoke-like manner are provided on the outside of the housing body 7 which considerably increase the stability of the housing body 7. Furthermore, axially outwardly projecting screw bosses 21 are disposed on the side wall 18.

The housing cover 8 is secured to the housing body 7 by means of several connecting screws 22 and comprises a central hub portion 23 that radially and axially delimits a partial hub receiving space 24. A radially outwardly extending annular side wall 25 adjoins the hub portion 23. A circumferential channel portion 26 is joined to the outside of the side wall 25. A rolling-element bearing 27 for the drive shaft 9 is disposed in the hub portion 23. The hub portion 23, the side wall 25 and the channel portion 26 form an integral cast part which forms the housing cover 8. Rib webs 28 extending in a spoke-like manner are also provided on the side wall 25 so as to increase the stability of the housing cover 8.

The housing body 7 and the housing cover 8 are joined together in a way that the two partial hub receiving spaces 16, 24 define a hub receiving space 29 between each other, and the two channel portions 19, 26 define a side channel 30 between each other for compression of the gas. The two side walls 18, 25 are parallel but spaced from each other. The side channel 30 extends annularly about the central longitudinal axis 4 at a distance therefrom and is delimited by the channel portions 19, 29.

An axial gas inlet opening 31 that opens into the side channel 30 is formed at the bottom of the housing cover 8. Furthermore, an axial gas outlet opening 32 is provided at the bottom of the housing cover 8, which gas outlet opening 32 is in flow connection with the side channel 30 and is adjacent to the gas inlet opening 31. A projecting gas inlet connector 33 is connected to the gas inlet opening 31 while a corresponding gas outlet connector 34 projecting in a likewise manner is connected to the gas outlet opening 32. An interceptor 35 is disposed in the side channel 30 between the gas inlet opening 31 and the gas outlet opening 32.

The hub foot 12 of the impeller 2 is disposed in the hub receiving space 29 defined by the hub portions 15, 23, with the driving shaft 9 passing through the hub bore 17. At the end of the drive shaft 9 is disposed a free bearing journal 36 which is mounted for rotation in the rolling-element bearing 27 disposed in the housing cover 8. The rolling-element bearing 27 has an inner ring 37 connected to the bearing journal 36 and an outer ring 38 connected to the housing cover 8, the rings 37, 38 being separated from each other by rolling elements in the shape of bearing balls 39 that are disposed therebetween. The inner ring 37 is shrunk onto the bearing journal 36 for co-rotation therewith while the outer ring 38 is secured to the housing cover 8 in a non-rotational manner. Between the spaced-apart side walls 18, 25 of the housing 3, the hub washer 13 of the impeller 2 extends radially outwardly from the hub foot 12. The carrier ring 14 and the impeller blades 1 are located in the circumferential side channel 30. A certain region of the foot of the carrier ring 14 is located in a recess 40 that is open to the outside and is formed in the channel portions 19, 26 next to the side walls 18, 25.

The side channel 30 has a free cross-sectional area A that is available for transporting the gas and is approximately perpendicular to the arrow 5. The cross-sectional area decreases non-monotonically from the gas inlet opening 31 having a cross-sectional area $A_E$ towards the gas outlet opening 32 having a cross-sectional area $A_A$, with $A_A<A_E$. The taper ratio between the gas inlet opening 31 and the gas outlet opening 32 amounts to between 20% and 60%, and preferably to between 25% and 50%. The side channel 30 has an axial width B which is defined by the channel portions 19, 26 of the housing 3, and a constant radial depth T which is defined by the channel portions 19, 26. In any case, the cross-sectional area A has an approximately rectangular shape with rounded corner regions, wherein the depth T is always smaller than the width B. The approximate cross-sectional area A of the side channel 30 can be obtained by multiplying width B by depth T. Each of the impeller blades 1 has a radial height. A height H of the free portion of an impeller blade 1 projecting into the side channel 30 amounts to between approximately 50% and 75%, preferably to approximately 60%, of the depth T of the side channel 30. Furthermore, each impeller blade 1 has a constant axial width S that is always considerably smaller than the width B of the side channel 30.

FIGS. 4 to 10 show in each case the side channel's 30 respective cross-sections at corresponding angular positions of the side channel compressor shown in FIG. 3 relative to the central longitudinal axis 4 along the course of the side channel 30. The absolute decrease from the gas inlet opening 31 towards the gas outlet opening 32 is in particular shown in FIGS. 4 to 10. FIG. 4 shows the cross-section of the side channel 30 just behind the gas inlet opening 31 when seen in the direction of the arrow 5. FIG. 10 on the other hand shows the cross-section of the side channel 30 just in front of the gas outlet opening 32 when seen in the direction of the arrow 5. The cross-sectional area A according to FIG. 4 considerably exceeds the cross-sectional area A according to FIG. 10. The change in cross-sectional area A is achieved by merely changing the width B.

The following angles are relative to the vertical plane E which crosses the central longitudinal axis 4 and intersects the side channel compressor in a vertically symmetrical manner, more specifically along the length thereof. The angles are furthermore relative to the central longitudinal axis 4 of the side channel compressor shown in FIG. 3. Seen in the direction of the arrow 5, the angles indicate angular distances starting from the gas inlet opening 31. The indicated numerical values concern a particularly preferred embodiment. The center of the gas inlet opening 31 is located at approximately 30°. The cross-section according to FIG. 4 is disposed at approximately 60°, while the cross-section according to FIG. 5 is at 90°, the cross-section according to FIG. 6 is at 135°, the cross-section according to FIG. 7 is at 180°, the cross-section according to FIG. 8 is at 225°, the cross-section according to FIG. 9 is at 270° and the cross-section according to FIG. 10 is at approximately 300°. The center of the gas outlet opening 32 is located at approximately 330°.

Compared to the cross-sectional area A according to FIG. 4, the cross-sectional area A according to FIG. 5 has decreased considerably, namely by approximately 25% to 35%. Compared to the cross-sectional area A shown in FIG. 5, the cross-sectional area A according to FIG. 6 has slightly increased again, namely by 10% to 20%. The cross-sectional area A according to FIG. 6 is thus smaller than the cross-sectional area A according to FIG. 4. When comparing FIG. 6 and FIG. 7, it also becomes obvious that the cross-sectional area A according to FIG. 7 is slightly larger than the cross-sectional area A according to FIG. 6. The cross-sectional area A according to FIG. 7 is approximately equal to the cross-sectional area A according to FIG. 4. Compared to the cross-sectional area A according to FIG. 7, the cross-sectional area A according to FIG. 8 has decreased considerably again. The cross-sectional area A according to FIG. 8 is approximately equal to the cross-sectional area A according to FIG. 5. The cross-sectional area A according to FIG. 9 again slightly exceeds the cross-sectional area A shown in FIG. 8 and is approximately equal to the cross-sectional area A according to FIG. 6. Compared to FIG. 9, the cross-sectional area A according to FIG. 10 is again slightly smaller and is approximately equal to the cross-sectional area A according to FIG. 5. As already mentioned, the change in cross-sectional area A was in each case achieved by correspondingly changing the width B. The width B of the side channel 30 approximately varies between 1.2 times the width S of the impeller blade 1 and 3.0 times the width S of the impeller blade 1. The width B of the side channel 30 preferably varies approximately between 1.5 and 1.9 times the width S of the impeller blade 1 in FIGS. 5, 8 and 10, and between 2.1 and 2.5 times the width S of the impeller blade 1 in FIGS. 4 and 7. In FIGS. 6 and 9, the width B approximately amounts to between 1.8 and 2.2 times the width S.

The side channel 30 can be modified by designing the channel portion 19 and/or the channel portion 26 correspondingly.

The drive 6 is an electric motor that is detachably connected to the outside of the housing body 7. To this end, several fastening screws are provided which are screwed in the screw bosses 21 at the housing body 7.

Support feet 41 are formed at the bottom of the side channel compressor to ensure secure mounting of the unit comprising side channel compressor and drive 6, wherein support feet 43 are also formed at the bottom of a carrier body 42 that is connected to the housing body by means of screws and carries the drive 6.

The following is a description of the function of the inventive side channel compressor. The drive shaft 9 is set in rotation about the central longitudinal axis 4 in the direction of the arrow 5 by way of the drive 6. Consequently, as the impeller 2 is coupled to the drive shaft 9 for co-rotation therewith, the impeller 2 comprising the impeller blades 1 starts to rotate in the direction of the arrow 5 as well. Passing close to the gas inlet opening 31, the impeller blades 1 draw the gas to be compressed into the side channel 30 via the gas inlet connector 33 and the gas inlet opening 31. The impeller blades 1 accelerate the gas located in the side channel 30 in the direction of the arrow 5 which may therefore also be referred to as transport arrow. The gas is trapped in cells that are inwardly defined by the carrier ring 14 and by adjacent impeller blades 1 in the circumferential direction. At the end of the circulation zone, the impeller blades 1 discharge the compressed gas from the side channel 30 via the gas outlet opening 32 and the gas outlet connector 34. The distance covered by the gas in the side channel is thus equivalent to an angular range of 300°. The interceptor 35 prevents the gas transported by the impeller 2 to the gas outlet opening 32 from being carried over to the gas inlet opening 31 via the side channel 30. The smaller the cross-sectional area A, the higher the velocity of the gas in the side channel 30. On the other hand, the larger the cross-sectional area A, the lower the velocity of the gas in the side channel 30.

Figure 11:
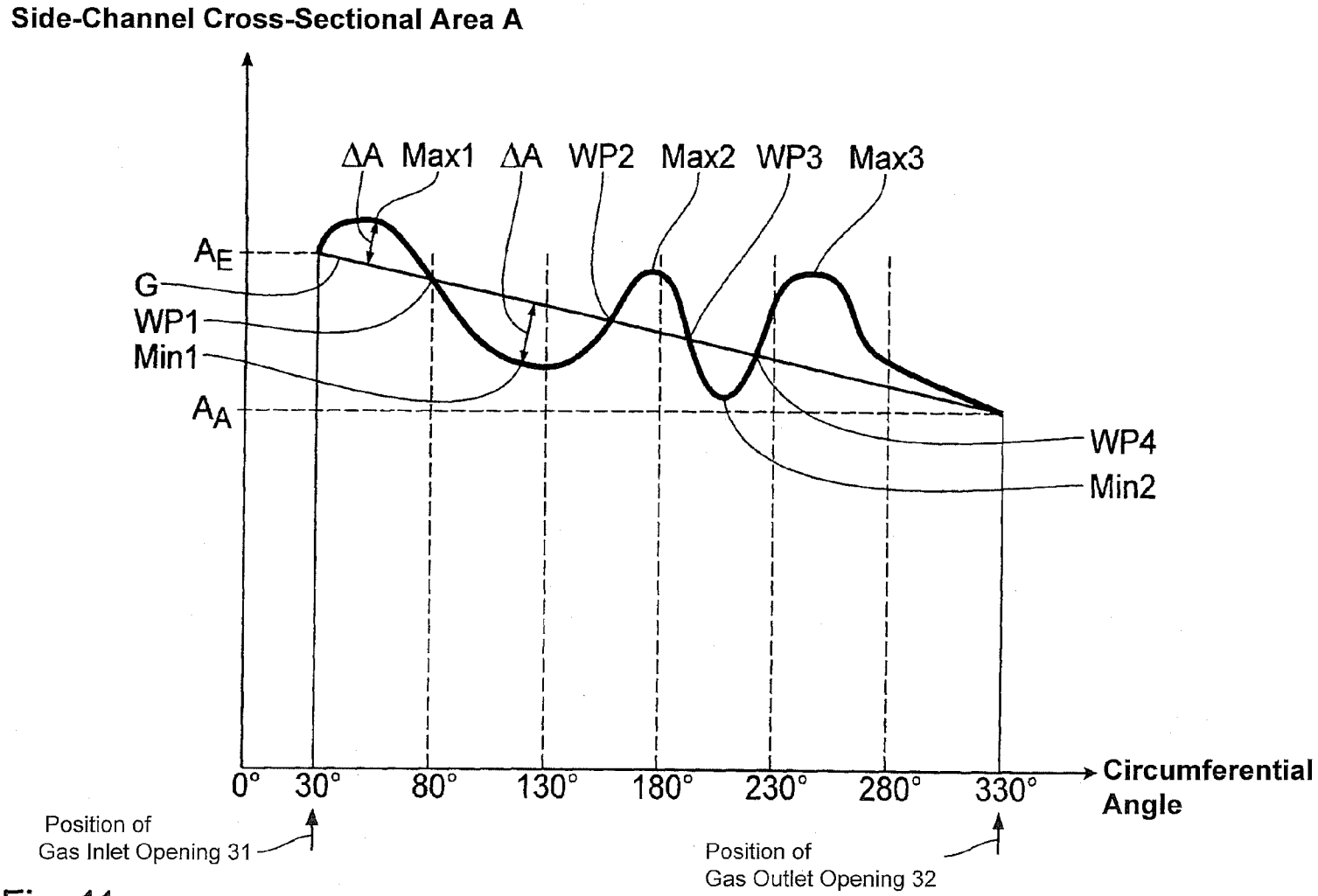
FIG. 11 shows the course of the side-channel cross-section from the gas inlet opening to the gas outlet opening of an inventive side channel compressor according to another embodiment.

The following is a detailed description, with reference to FIG. 11, of the course of the cross-sectional area A between the gas inlet opening 31 and the gas outlet opening 32 in another preferred embodiment of a side channel compressor's side channel 30 relative to the circumferential angle or the circulation, respectively, according to the above definition. This embodiment and the previous embodiment to which reference is made only differ from each other in terms of the design of their respective side channels 30. Again, the change in cross-sectional area A is achieved by merely changing the width B.

As shown in FIG. 11, the cross-sectional area A of the side channel 30 at first increases considerably downstream of the gas inlet opening 31 located at approximately 30° until a first maximum Max1 is reached at approximately 50°. Afterwards, the cross-sectional area A decreases slowly until a first minimum Min1 is reached at approximately 115°. A first inflection point WP1 is situated at approximately 80°; this is where the curvature of the curve or the tapering of the side channel 30, respectively, changes. Downstream of the inflection point WP1, the cross-sectional area decreases less quickly than upstream of the inflection point WP1. Downstream of the minimum Min1, the cross-sectional area A of the side channel 30 increases considerably again until a second maximum Max2 is reached which is situated at approximately 180°; at approximately 155°, the curve passes through a second inflection point WP2. At the maximum Max2, the cross-sectional area A of the side channel 30 is smaller than at the maximum Max1. Downstream of the maximum Max2, the cross-sectional area A of the side channel 30 decreases considerably again and reaches a second minimum Min2 at approximately 205° where the cross-sectional area A of the side channel 30 is slightly smaller than at the minimum M1, wherein the curve passes through a third inflection point WP3 at approximately 190°. Downstream of the minimum Min2, the cross-sectional area A of the side channel 30 increases considerably again until a third maximum Max3 is reached at approximately 245° where the cross-sectional area A of the side channel 30 is approximately equal to the cross-sectional area A at the second maximum Max2. Downstream of the maximum Max3, the cross-sectional area A of the side channel 30 decreases considerably again until approximately 265°, and tapers slightly but steadily until the gas outlet opening 32 at 330° is reached. For comparison, a straight line G is included in FIG. 11 which shows a steady decrease of the cross-sectional area A between the gas inlet opening 31 and the gas outlet opening 32. The maxima Max1, Max2 and Max 3 are disposed above the straight line G while the minima M1 and M2 are disposed below line G. The inflection points WP1, WP2 and WP3 are disposed exactly along line G.

As shown in FIG. 11, the maxima Max1, Max2 and Max3 are disposed at irregular distances from each other, which results in an aperiodic distribution across the circumference. The angular distance between maximum Max1 and maximum Max2 amounts to approximately 130° while the angular distance between maximum M2 and maximum M3 amounts to approximately 65°. Consequently, the distance has reduced. Likewise, the inflection points WP1, WP2 and WP3 are not disposed equidistantly along the circumference either but are disposed aperiodically as well. Between inflection point WP1 and inflection point WP2, there is an angular distance of approximately 75° while the angular distance between the inflection point WP2 and WP3 only amounts to 35°.

Between the gas inlet opening 31 and the gas outlet opening 32, the variation of the cross-sectional area A of the side channel 30 amounts to between 20% and 60%, preferably to between 25% and 50%, relative to the difference of the cross-sectional area A between the gas inlet opening 31 and the gas outlet opening 32 and is referred to as ΔA. The variation is present between the extreme values and the straight line G.

In the above described embodiments, the cross-sectional area A of the side channel 30 was changed by changing the width B. In an alternative embodiment, the cross-sectional area A of the side channel 30 is changed correspondingly by changing the depth T. Otherwise, the above description shall apply accordingly. In terms of fabrication, however, changing the cross-sectional area A of the side channel 30 by changing the width B is preferred. According to an alternative embodiment, the cross-sectional area A is changed by simultaneously changing the depth T and the width B.

As mentioned at the outset, a strictly monotonic decrease in cross-sectional area with an irregular decrease behavior is conceivable as well. Again, periodic decrease patterns should be avoided, in other words inflection points should be distributed aperiodically. Likewise, the amplitudes should be irregular as well.

The invention is also applicable correspondingly in multi-stage side channel compressors. An implementation thereof in multi-flow side channel compressors is conceivable as well.

The above descriptions of embodiments are for example only. The maxima and minima may be randomly distributed across the circumference and disposed at any desired position. Equal distances should be avoided. Likewise, the connections between the extreme values may also rise and fall to different extents. The amplitude values may also be selected randomly. What is essential is to avoid a regular course in order to prevent harmonic flow structures. Therefore, at least one maximum, one minimum and/or one inflection point are provided. Several maxima, minima and/or inflection points are preferred, however.

What is claimed is:

1. A side channel compressor for compressing a gas, comprising:

a) a housing;

b) a side channel for compressing a gas, the side channel being located in the housing and having a cross-sectional area, wherein the side channel has a varying axial width;

c) a gas inlet opening formed in the housing, the gas inlet opening being in flow connection with the side channel for introduction of a gas;

d) a gas outlet opening formed in the housing for discharge of the gas to be compressed from the side channel, with the gas outlet opening being in flow connection with the gas inlet opening via the side channel;

e) an impeller which is mounted for rotation in the housing and comprises impeller blades disposed in the side channel;

f) wherein the cross-sectional area of the side channel decreases from the gas inlet opening towards the gas outlet opening; and g) wherein a course of the cross-sectional area of the side channel has several inflection points between the gas inlet opening and the gas outlet opening, wherein the distance between the inflection points is aperiodic.

2. A side channel compressor according to claim 1, wherein the cross-sectional area of the side channel decreases irregularly between the gas inlet opening and the gas outlet opening.

3. A side channel compressor according to claim 1, wherein the cross-sectional area of the side channel decreases non-monotonically between the gas inlet opening and the gas outlet opening.

4. A side channel compressor according to claim 3, wherein the cross-sectional area of the side channel increases in some regions between the gas inlet opening and the gas outlet opening.

5. A side channel compressor according to claim 3, wherein the course of the cross-sectional area of the side channel has at least one maximum between the gas inlet opening and the gas outlet opening.

6. A side channel compressor according to claim 1, comprising an impeller shaft, the angular distance between two adjacent inflection points amounting to between 20° and 90° relative to the impeller shaft.

7. A side channel compressor according to claim 6, wherein the angular distance between two adjacent inflection points amounts to between 30° and 80° relative to the impeller shaft.

8. A side channel compressor according to claim 1, wherein 3 to 13 impeller blades are provided between two adjacent inflection points.

9. A side channel compressor according to claim l, wherein 5 to 10 impeller blades are provided between two adjacent inflection points.

10. A side channel compressor according to claim 1, wherein the cross-sectional area of the side channel decreases by 20% to 60% from the gas inlet opening to the gas outlet opening.

11. A side channel compressor according to claim 1, wherein the cross-sectional area of the side channel decreases by 25% to 50% from the gas inlet opening to the gas outlet opening.

12. A side channel compressor according to claim 1, wherein the variation of the cross-sectional area of the side channel amounts to between 20% and 60% relative to the difference of the cross-sectional area between the gas inlet opening and the gas outlet opening.

13. A side channel compressor according to claim 1, wherein the variation of the cross-sectional area of the side channel amounts to between 30% and 50% relative to the difference of the cross-sectional area between the gas inlet opening and the gas outlet opening.

* * * * *